US006752061B2

(12) United States Patent
Knorich et al.

(10) Patent No.: US 6,752,061 B2
(45) Date of Patent: Jun. 22, 2004

(54) GUN

(75) Inventors: Friedhelm Knorich, Düsseldorf (DE); Berthold Baumann, Eschede (DE)

(73) Assignee: Rheinmetall W & M GmbH, Unterluss (DE)

( * ) Notice: Subject to any disclaimer, the term of this patent is extended or adjusted under 35 U.S.C. 154(b) by 0 days.

(21) Appl. No.: 10/414,242

(22) Filed: Apr. 16, 2003

(65) Prior Publication Data

US 2004/0020352 A1 Feb. 5, 2004

(30) Foreign Application Priority Data

Jun. 14, 2002 (DE) ..... 102 26 534

(51) Int. Cl.[7] ..... F41A 21/00

(52) U.S. Cl. ..... 89/14.05; 89/37.13; 89/37.01; 42/75.02

(58) Field of Search ..... 42/75.02; 89/37.13, 89/37.01, 14.05

(56) References Cited

U.S. PATENT DOCUMENTS 2,602,255 A * 7/1952 Cutts
2,756,635 A * 7/1956 Engel et al.
4,638,714 A * 1/1987 Heintz et al. ..... 89/37.01
5,155,291 A * 10/1992 Dabrowski ..... 89/14.05
6,591,534 B1 * 7/2003 Trudeau et al. ..... 42/75.02
6,606,812 B1 * 8/2003 Gwinn, Jr. ..... 42/75.02

FOREIGN PATENT DOCUMENTS

GB 2278187 * 11/1994 ..... 42/75.02

* cited by examiner

*Primary Examiner*—Michael J. Carone
*Assistant Examiner*—L. Semuneous
(74) *Attorney, Agent, or Firm*—Venable LLP; Stuart I. Smith

(57) ABSTRACT

A gun whose barrel (2') is connected to a breech ring (16), and is seated to be displaced in a cradle barrel (3). To prevent a lifting effect of the barrel (2') inside the cradle barrel (3) upon firing, a slide-bushing bearing is disposed on at least the muzzle side of the barrel (2'). The bearing encompasses a barrel bushing (7'), in which the barrel (2') is disposed free from any lifting effect, and whose outside surface (8) slides in a form-fit (i.e., with the smallest possible amount of play) in the cradle barrel (3), so that the barrel (2') is independently guided to slide both axially and radially. The radial sliding guidance of the barrel (2') during firing is effected by tab-shaped protrusions (10'), which extend into corresponding, groove-shaped recesses (9') of the barrel bushing (7') and hold the barrel (2') in the center of the barrel bushing (7').

8 Claims, 3 Drawing Sheets

Fig.2
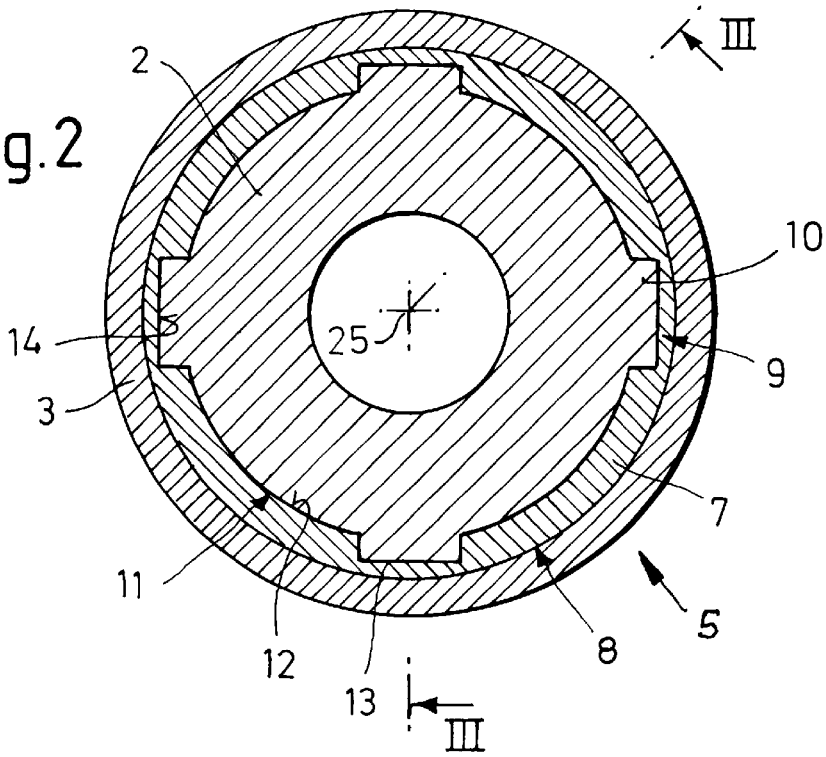
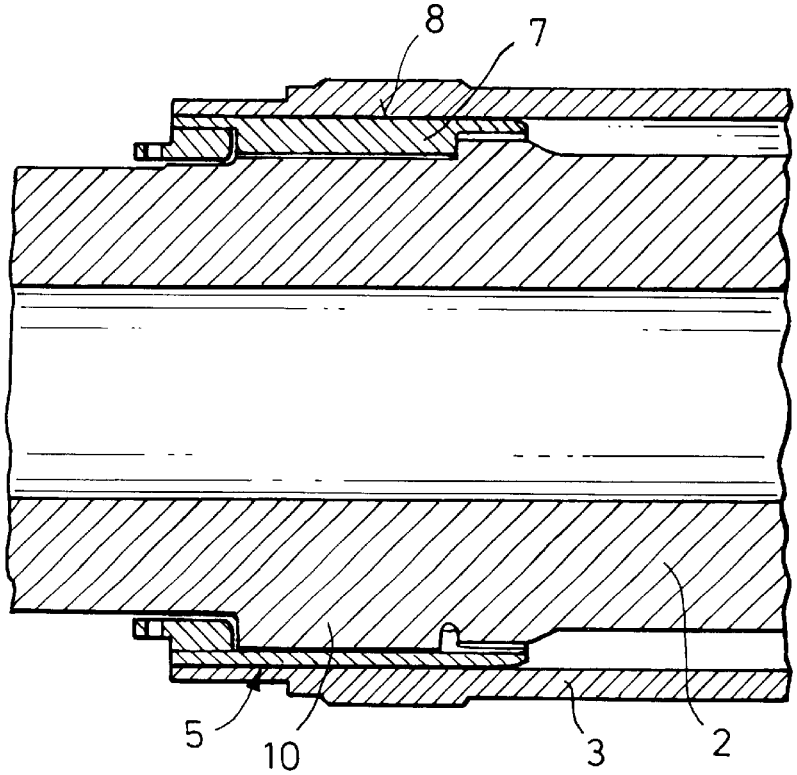
Fig.3

GUN

CROSS REFERENCE TO RELATED APPLCIATION

This application claims the priority of German Patent Application DE 102 26 534.8 filed Jun. 14, 2002, which is incorporated herein by reference.

BACKGROUND OF THE INVENTION

The invention relates to a gun in which the barrel, which is connected to a breech ring, is seated to be displaced in a barrel of a cradle.

A gun of this type is known from, for example, German Published Application No. DE 31 48 265 A1. Here, the barrel is seated in two slide-bushing bearings, which are disposed at the muzzle- and breech-side ends of the cradle barrel. A disadvantage of this type of known slide-bushing bearing is that the gun barrel, for example of a tank cannon, must rest on the lower inside edge of the bearing, as stipulated by its mass, and lifts due to the expansion of the barrel during firing. This causes the barrel to vibrate, and has a negative effect on the jump error of the respective projectile.

From German Published Patent Application No. DE 39 36 454 A1, it is known to avoid barrel vibrations during firing by using lift-effect-free bearings instead of conventional slide-bushing bearings. With the former, the gun barrel does not impact a fixed stop in the radial direction upon firing, so the barrel can expand in both the horizontal and vertical directions. For seating the barrel in the cradle barrel, four guide rails are provided, the rails being uniformly spaced over the circumference of the barrel, extending in the direction of the longitudinal axis and being embodied or formed as slide rails. The rails extend into corresponding guide grooves of the cradle barrel such that the directions of the support force and the radial barrel expansion are perpendicular to one another.

The primary drawback of this seating arrangement is that the guide rails and guide grooves extend past both bearing points, and are therefore very costly to produce. Furthermore, exchanging the barrel in such guns is a complicated and time-consuming procedure.

In view of DE 39 36 454 A1, it is the object of the invention to provide a gun that is seated to be displaced in a cradle barrel, and in which the lifting effect of the gun barrel is extensively avoided and complex guide grooves are not required in the cradle barrel, and which permits the barrel to be exchanged as in conventional gun seating arrangements.

SUMMARY OF THE INVENTION

The above object generally is achieved according to the present invention, by a gun in which the barrel, which is connected to a breech ring, is seated to be axially displaced in a cradle barrel, and wherein: the barrel is seated in a first slide-bushing bearing that is disposed at the muzzle-side end, and in a second slide-bushing bearing that is disposed at the breech ring-side end of the cradle barrel; at least the first slide-bushing bearing is constructed to be free of any lifting effect, and encompasses a barrel bushing, whose outside surface is seated to slide in the cradle barrel; on the inside, the first barrel bushing has at least three groove-shaped recesses that are uniformly spaced over the circumference; at least three tab-shaped protrusions are disposed on the gun barrel, with the protrusions extending into the respective groove-shaped recesses of the first barrel bushing; and, a predetermined amount of play is provided between the outside surface of the gun barrel, or an inside ring that supports the tab-shaped protrusions and is in a form-fit connection with the barrel, and the inner surface of the barrel bushing, and between the tab heads and the inner surface of the groove-shaped recesses of the barrel bushing, with the expansion of the gun barrel during firing being within this region of play. Further, especially advantageous embodiments of the invention are disclosed.

The invention is essentially based on the concept of arranging a slide-bushing bearing on the barrel, at least on the muzzle-side, but preferably also at the rear, with the bearing encompassing a barrel bushing in which the barrel is disposed free from a lifting effect, and whose outside surfaces slide with a form-fit in the cradle barrel that is, with the smallest possible amount of play. Consequently, unlike in DE 39 36 454 A1, the barrel is independently guided to slide both axially and radially. Similarly to DE 39 36 454 A1, the radial sliding guidance of the barrel during firing is effected by means of tab-shaped protrusions, which extend into corresponding, groove-shaped recesses of the barrel bushing and hold the barrel in the center of the barrel bushing. A predetermined amount of play is provided between the barrel, or an inside ring that is secured to the barrel against relative rotation and supports the tab-shaped protrusions, and the inside surface of the barrel bushing, with the play permitting compensation of radial expansion of the gun barrel.

Due to the absence of an axial rail guidance, the gun is less costly to produce than comparable guns. Moreover, the proposed seating arrangement of the barrel is very sturdy, and permits conventional slide bushings that are already in use to be exchanged easily for the novel, grooved barrel bushings that keep the barrel in a central position.

For exchanging the barrel quickly in the field, it has proven advantageous to connect the barrel bushing of the forward (first) slide-bushing bearing permanently to the barrel, and to connect the barrel bushing of the rear (second) slide-bushing bearing permanently to the breech ring. When the barrel is exchanged, the first barrel bushing remains on the barrel, and is disassembled with it. The second barrel bushing remains on the breech ring, and is guided centrally over its outside diameter in the cradle barrel.

If the length of the barrel bushing of the second slide-bushing bearing is selected such that the barrel bushing is pulled completely out of the cradle barrel when the barrel recoils, an additional slide bushing with a predetermined amount of fit play should be disposed at the muzzle side in the cradle barrel, in front of the rear slide-bushing bearing. The additional slide bushing assumes the task of guiding the barrel when the barrel bushing of the second slide-bushing bearing is pulled out of the cradle barrel.

The length of the second slide-bushing bearing can, however, also be selected such that the barrel bushing does not leave the cradle barrel upon recoil, so an additional slide bushing can be omitted.

Further details about and advantages of the invention ensue from the following exemplary embodiments explained in conjunction with figures.

BRIEF DESCRIPTION OF THE DRAWINGS

FIG. 2 is a cross-section through a first embodiment of a slide-bushing bearing along the sectional line represented by II—II in FIG. 1.

FIG. 3 is a longitudinal section through the slide-bushing bearing shown in FIG. 2, along the sectional line represented thereby III—III.

DETAILED DESCRIPTION OF THE INVENTION

Figure 1:
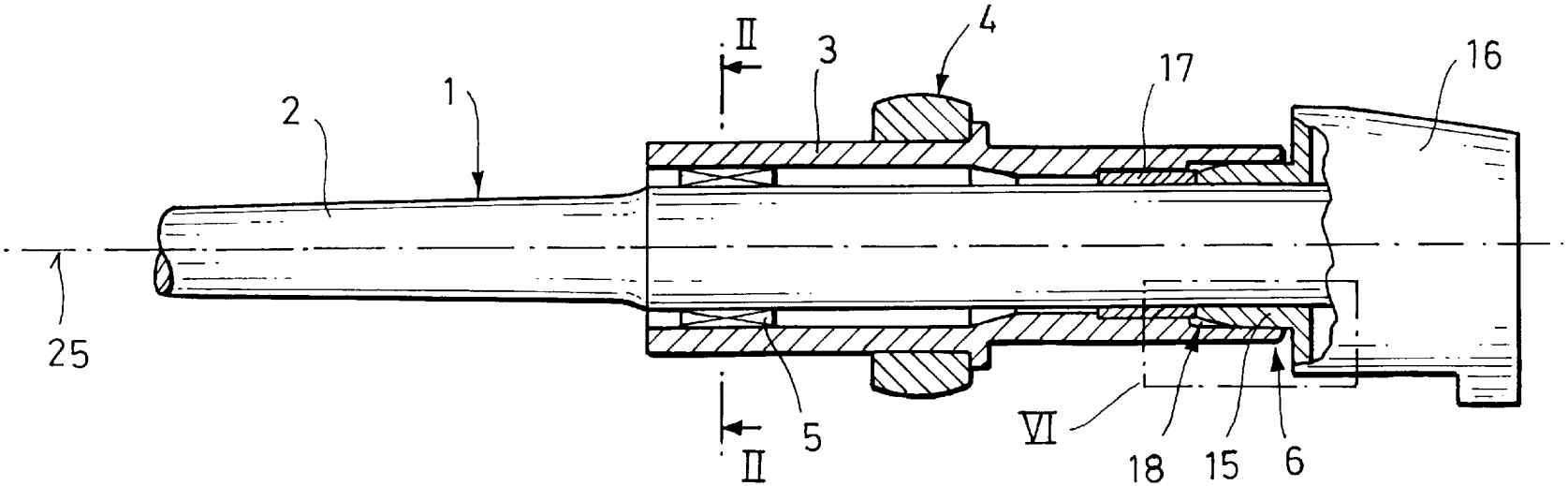
FIG. 1 is a schematic representation of a gun barrel having a slide-bushing bearing at the muzzle-side end of the cradle barrel, and one at the end of the cradle barrel on the side of the breech ring.

In FIG. 1, a gun 1 has a barrel 2, which is seated to be axially displaced in a cradle barrel 3 of a cradle 4. To this end, a first slide-bushing bearing 5 is disposed at the muzzle-side end of the cradle barrel 3, and a second slide-bushing bearing 6 is disposed at the breech end of the cradle barrel 3.

The first slide-bushing bearing 5 encompasses a barrel bushing 7 (FIGS. 2 and 3), whose outside surface 8 is seated to slide in the cradle barrel 3, with the smallest possible amount of fit play being provided between the surface 8 of the barrel bushing 7 and the inner surface of the cradle barrel 3. On its inside or inner surface, the barrel bushing 7 has a plurality, e.g., four as shown, of groove-shaped recesses 9, which are uniformly spaced over the circumference of the bushing 7. Tab-shaped protrusions 10 secured to or formed on the outside surface 11 of the barrel 2 extend into these recesses 9.

A predetermined amount of play is provided between the outside surface 11 of the barrel 2 and the inside surface 12 of the barrel bushing 7, as well as between the tab heads or end surfaces 13 and the adjacent inside surface 14 of the groove-shaped recesses 9 of the barrel bushing 7. In FIGS. 2 and 3, this play is represented by a thick black line. On the other hand, the side or radially extending surfaces of the protrusions 10 rest in a form-fit against the corresponding side or radially extending surfaces of the respective recesses 9.

The second slide-bushing bearing 6 (FIG. 1) is constructed similarly to the first slide-bushing bearing 5, and likewise encompasses a grooved barrel bushing 15 that guides the barrel 2 in the center. In this instance, the barrel bushing 15 is screwed or fastened to a breechring 16.

A conventional slide bushing 17 is disposed, with a predetermined amount of fit play, in front of the second slide-bushing bearing 6 in the cradle barrel 3.

The function of the gun 1 according to the invention, and thus the function of the slide-bushing bearings 5 and 6, are discussed below:

When a projectile is fired from the gun 1, the barrel 2 expands elastically as the projectile passes through the barrel 2, and the tab-shaped protrusions 10 disposed on the barrel 2 are displaced radially inside the groove-shaped recesses 9 in the barrel bushings 7 and 15. Because of the play provided between the barrel 2 and the barrel bushings 7 and 15, the barrel bushings 7 and 15 are not deformed, and can be axially displaced toward the inside cradle diameter via their outside surfaces 8, which are coated for sliding and provided with the smallest amount of play, without the risk of a jam inside the cradle barrel 3. Because of the uniform radial displacement of the outside gun wall inside the slide-bushing bearing, the barrel 2 is always guided in the center, so as the projectile passes through, a lifting effect and its negative effects on the hit capability of the projectile are precluded.

The second slide-bushing bearing 6 connected to the breech ring 16 and the barrel 2 recoils with these units as the barrel recoils, i.e., the second barrel bushing 6 first leaves the cradle barrel 3 and is then re-inserted into the cradle barrel 3 via an insertion slope or ramp 18 (FIG. 1) when the barrel 2 advances. After the barrel 2 leaves the barrel bushing 15 guided with little play, the slide bushing 17 seated in front of it assumes the task of guiding the barrel. The slide bushing 17 and the barrel 2 have a predetermined, relatively large amount of play for reliably assuring the insertion of the barrel bushing 15 into the cradle barrel 3 and avoiding a jam when the barrel expands as the projectile passes through.

Figure 4:
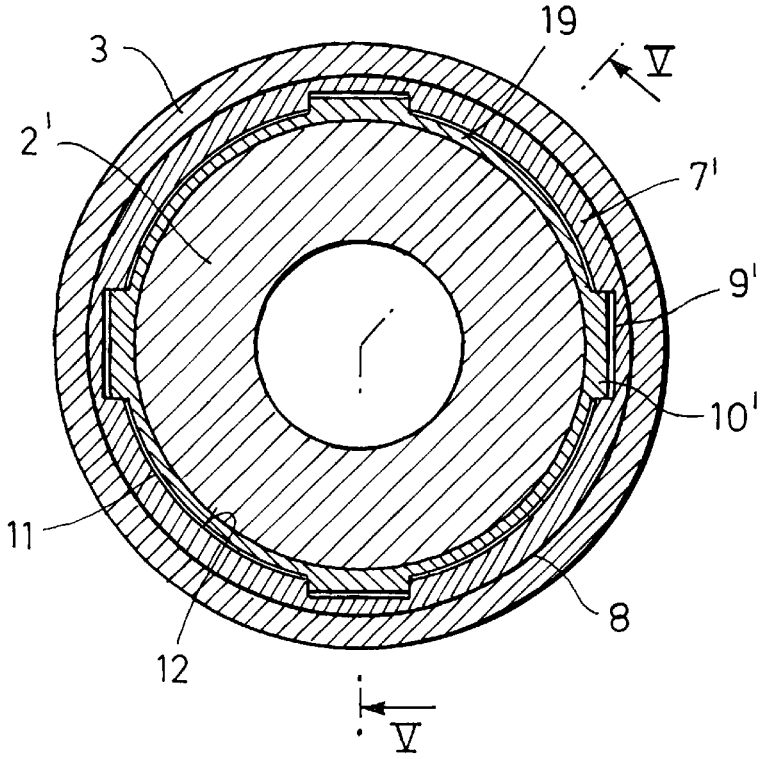
FIG. 4 is a cross-section, corresponding to FIG. 2, through a further embodiment of a slide-bushing bearing.
Figure 5:
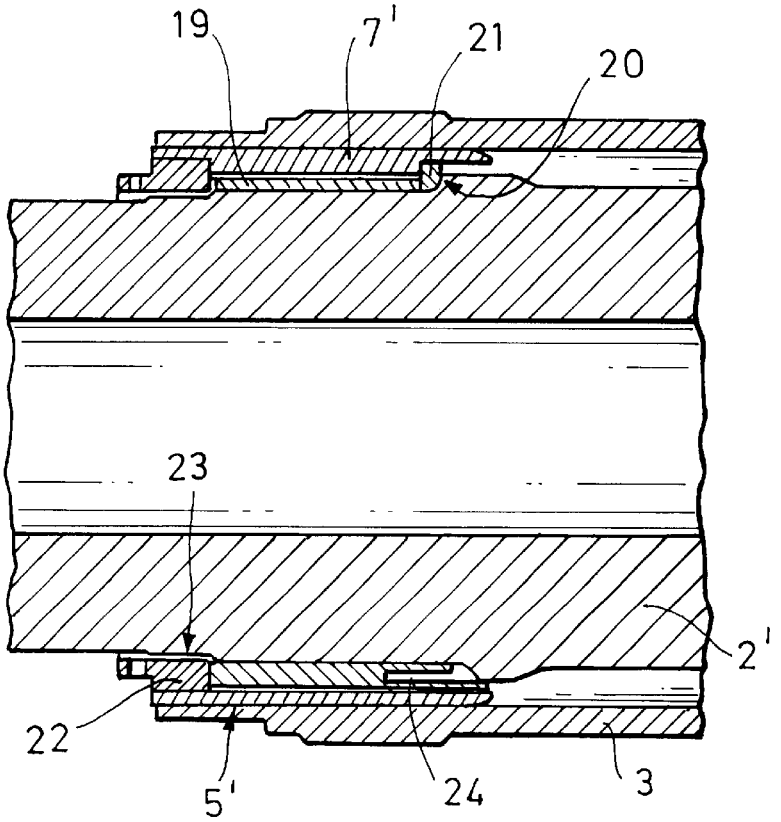
FIG. 5 is a longitudinal section through the slide-bushing bearing shown in FIG. 4, along the sectional line represented there by V—V.

FIGS. 4 and 5 illustrate a second exemplary embodiment of a first slide-bushing bearing 5', which corresponds to FIGS. 2 and 3, and has a barrel bushing 7'. The four tab-shaped protrusions 10' are not attached directly to the barrel 2', but to an inside ring 19 that is attached, secured against relative rotation and with a small amount of play, to the barrel 2'. The groove-shaped recesses of the barrel bushing 7' are represented by 9'.

A holding ring 21 is seated between an end surface of the inside ring 19 and a barrel shoulder represented by 20 (FIG. 5). The inside ring 19 and the holding ring 21 are held axially by a counter-ring 22, which is screwed to the barrel 2' via a thread 23 and abuts the opposite end surface of the inside ring 19. The holding ring 21 and the counter-ring 22 form the axial boundary for the barrel bushing 7'. Furthermore, two anti-rotation retaining devices 24 prevent the barrel bushing 7' from rotating about the barrel axis 25.

Figure 6:
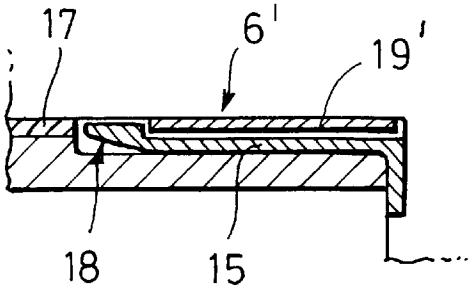
FIG. 6 is an enlarged view of the region represented by VI in FIG. 1 for an embodiment of a slide-bushing bearing disposed at the rear end of the cradle barrel.

FIG. 6 is an enlarged, detailed representation of a second slide-bushing bearing 6', which essentially corresponds to the first slide-bushing bearing 5' and in which the tab-shaped protrusions, not shown, are likewise secured to an inside ring 19' that is disposed so as not to rotate on the barrel 2'.

The invention now being fully described, it will be apparent to one of ordinary skill in the art that many changes and modifications can be made thereto without departing from the spirit or scope of the invention as set forth herein.

What is claimed is:

1. A gun having a barrel that is connected to a breech ring and that is seated to be axially displaced in a cradle barrel of a gun cradle, and wherein:

the gun barrel is seated at least in a first slide-bushing bearing disposed at the muzzle-side end of the cradle barrel, and in a second slide-bushing bearing disposed at the breech ring-side end of the cradle barrel;

at least the first slide-bushing bearing is constructed to be free of any lifting effect, and including a barrel bushing, whose outer surface is seated to slide in the cradle barrel;

an inner surface of the first barrel bushing has at least three groove-shaped recesses, that are uniformly spaced over the circumference of the first barrel bushing;

a plurality of tab-shaped protrusions corresponding to the number of said recesses is disposed on one of an outer surface of the gun barrel and an outer surface of an inside ring disposed on an outer surface of the gun barrel in a form-fit connection with the barrel gun, with the protrusions extending into respective groove-shaped recesses of the barrel bushing; and a predetermined amount of play is provided between the outer surface of the gun barrel or of the interior ring and the inner surface of the barrel bushing, and between respective end surfaces of the protrusions and respective adjacent inner surfaces of the respective groove-shaped recess of the barrel bushing with an expansion of the gun barrel during firing being within the predetermined amount of play.

2. The gun according to claim 1, wherein the tab-shaped protrusions are secured to the inside ring that is connected in a form-fit to the gun barrel.

3. The gun according to claim 1, wherein the tab-shaped protrusions is formed on the outer surface of the gun barrel.

4. The gun according to claim 1, wherein the second slide-bushing bearing is also constructed to be free of any lifting effect, and corresponds in design to the first slide-bushing bearing.

5. The gun according to claim 1, wherein at least the first barrel bushing has four groove-shaped recesses, which are uniformly spaced around the circumference, and into which the corresponding respective tab-shaped protrusion extends, and side surfaces of the respective protrusion rest in a form-fit against corresponding side surfaces of the groove-shaped recesses.

6. The gun according to claim 1, wherein the barrel bushing of the second slide-bushing bearing is connected to the breech ring for axial movement therewith.

7. The gun according to claim 6, wherein the length of the barrel bushing of the second slide-bushing bearing is such that the barrel bushing is completely pulled out of the cradle barrel when the gun barrel recoils; and an additional slide bushing is disposed, with a predetermined amount of play in the cradle barrel, in front of the second slide-bushing bearing, with the additional slide bushing assuming the task of guiding the gun barrel when the barrel bushing is pulled out of the cradle barrel during recoil.

8. The gun according to claim 5, wherein the length of the second slide-bushing bearing is such that the barrel bushing of the second slide-bushing bearing remains within the cradle barrel during recoil of the gun barrel.

* * * * *